US010954008B2

(12) United States Patent
Bertolin

(10) Patent No.: US 10,954,008 B2
(45) Date of Patent: Mar. 23, 2021

(54) METHOD FOR HANDLING PRIMARY CONTAINERS FOR PHARMACEUTICAL USE TRANSPORTED ALONG AN AUTOMATIC TREATMENT LINE OPERATING IN A CONTROLLED ENVIRONMENT

(71) Applicant: NUOVA OMPI S.R.L., Padua (IT)

(72) Inventor: Gianpaolo Bertolin, Padua (IT)

(73) Assignee: NUOVA OMPI S.R.L., Padua (IT)

( * ) Notice: Subject to any disclaimer, the term of this patent is extended or adjusted under 35 U.S.C. 154(b) by 193 days.

(21) Appl. No.: 16/311,908

(22) PCT Filed: Jul. 13, 2017

(86) PCT No.: PCT/IB2017/054242
§ 371 (c)(1),
(2) Date: Dec. 20, 2018

(87) PCT Pub. No.: WO2018/011748
PCT Pub. Date: Jan. 18, 2018

(65) Prior Publication Data

US 2019/0177013 A1 Jun. 13, 2019

(30) Foreign Application Priority Data

Jul. 15, 2016 (IT) ..... 102016000074164

(51) Int. Cl.
*B65B 3/00* (2006.01)
*B65B 7/28* (2006.01)
(Continued)

(52) U.S. Cl.
CPC ..... *B65B 3/003* (2013.01); *B65B 7/28* (2013.01); *B65B 55/08* (2013.01); *B65B 55/10* (2013.01)

(58) Field of Classification Search
CPC ..... B65B 3/003; B65B 35/32; B65B 35/38; B65B 35/40; B65B 35/46; B65B 35/56;
(Continued)

(56) References Cited

U.S. PATENT DOCUMENTS 2,704,147 A * 3/1955 Cozzoli ..... B65B 3/003 198/418.2
2,877,611 A * 3/1959 Anrep ..... B65B 3/003 53/86

(Continued)

FOREIGN PATENT DOCUMENTS

CN 101879778 A 11/2010
CN 102470933 A 5/2012

(Continued)

OTHER PUBLICATIONS

Chinese Search Report of corresponding Patent Appln. CN2017800389331 dated Apr. 11, 2020.

*Primary Examiner* — Stephen F. Gerrity
(74) *Attorney, Agent, or Firm* — Browdy and Neimark, PLLC

(57) ABSTRACT

The method for handling primary containers (2) for pharmaceutical use transported along an automatic treatment line (1) operating in a controlled environment from a contamination point of view comprises the following steps: introducing into the line a secondary container (6) equipped with rows of positioning seats (18) housing the primary containers (2) separately from one another; extracting in succession the primary containers (2) maintaining the primary containers (2) separate and transferring the extracted primary containers (2) to the treatment station (10) in succession one at a time.

14 Claims, 9 Drawing Sheets

(51) Int. Cl.
*B65B 55/10* (2006.01)
*B65B 55/08* (2006.01)

(58) Field of Classification Search
CPC ..... B65B 35/58; B65B 43/42; B65B 43/46; B65B 43/48; B65B 43/50; B65B 55/08; B65B 55/10; B65B 69/00; B65G 47/252
See application file for complete search history.

(56) References Cited

U.S. PATENT DOCUMENTS

| | | | | | |
|---|---|---|---|---|---|
| 4,867,315 | A * | 9/1989 | Baldwin | B65B 3/003 | 206/558 |
| 4,982,553 | A * | 1/1991 | Itoh | B67B 7/02 | 53/246 |
| 5,964,043 | A * | 10/1999 | Oughton et al. | F26B 5/06 | 34/92 |
| 2011/0277419 | A1 | 11/2011 | Nicoletti | | |
| 2012/0090268 | A1 | 4/2012 | Krauss et al. | | |
| 2013/0067867 | A1 | 3/2013 | Veile | | |
| 2014/0301895 | A1* | 10/2014 | Opie et al. | B65B 55/10 | 422/28 |
| 2014/0353190 | A1* | 12/2014 | Okihara et al. | B65B 55/10 | 206/370 |
| 2015/0089830 | A1* | 4/2015 | Wissner et al. | B65B 43/42 | 34/284 |
| 2016/0200461 | A1 | 7/2016 | Broadbent et al. | | |
| 2018/0126066 | A1* | 5/2018 | Narvekar et al. | B65B 3/003 | |
| 2018/0162572 | A1* | 6/2018 | Trilli et al. | B65B 3/003 | |
| 2018/0229866 | A1 | 8/2018 | Eberhardt et al. | | |
| 2018/0346305 | A1* | 12/2018 | Procyshyn et al. | B65B 69/00 | |

FOREIGN PATENT DOCUMENTS

| | | | | |
|---|---|---|---|---|
| CN | 202244222 | A | 5/2012 | |
| CN | 102941941 | A | 2/2013 | |
| CN | 104272049 | A | 1/2015 | |
| CN | 104507815 | A | 4/2015 | |
| DE | 522301 | C * | 4/1931 | B65B 3/003 |
| DE | 10028823 | A1 * | 12/2001 | B65B 3/003 |
| DE | 102014214697 | A1 | 1/2016 | |

* cited by examiner

METHOD FOR HANDLING PRIMARY CONTAINERS FOR PHARMACEUTICAL USE TRANSPORTED ALONG AN AUTOMATIC TREATMENT LINE OPERATING IN A CONTROLLED ENVIRONMENT

FIELD

The present invention relates to a method for handling primary containers for pharmaceutical or veterinary use.

BACKGROUND

As is known, primary containers for pharmaceutical use before being subjected to a treatment step, such as washing, filling and capping, are repeatedly handled for performing various combination, washing, sterilisation, inspection operations, etc.

One of the major drawbacks related to the handling of primary containers, such as glass for pharmaceutical use, is associated with the production of contaminating particles that originate from friction and shocks between the primary containers.

Often, the primary containers are in fact moved in bulk or are aggregated, either for storage, for transport or for the performance of specific operations, into secondary containers where they are placed in strict mutual contact.

Damage to or deterioration of the primary containers due to friction or shocks must be prevented as much as possible.

SUMMARY

In some cases, secondary containers are provided where the primary containers are arranged in separate position. Such secondary containers are used to transport the primary containers from a remote site to the treatment area, such as washing and/or filling and/or capping, on which they are fed loose with the risk of getting damaged due to mutual contact. The technical task of the present invention therefore is to provide a method for handling primary containers for pharmaceutical use, suitable for aiding the transportation thereof along an automatic treatment line, operating in a controlled environment from a contamination point of view, without the generation of contaminating particles.

Another object is to provide a method for handling primary containers for pharmaceutical use, suitable for aiding the transportation thereof under suitable protection conditions along an automatic treatment line, operating in a controlled environment from a contamination point of view.

Another object is to provide a method for handling primary containers for pharmaceutical use, suitable for aiding the transportation thereof along a highly productive automatic treatment line operating in a controlled environment from a contamination point of view.

Another object is to provide a method for handling primary containers for pharmaceutical use, suitable for aiding the transportation thereof along an automatic treatment line operating in a controlled environment from a contamination point of view without the risk of contamination and/or impairing the sterility and/or impairing the structural integrity thereof.

The technical task, as well as these and other objects according to the present invention are achieved by implementing a method for handling primary containers for pharmaceutical use transported along an automatic treatment line operating in a controlled environment from a contamination point of view, as defined in the appended claims.

In a preferred embodiment of the method, after the treatment step, such as the capping step, said primary containers are relocated in said secondary container without coming into contact with one another prior to the extraction from said line.

In a preferred embodiment of the method, the following operations are carried out before introducing said secondary container in said line: closing the secondary container with the primary containers housed therein, sterilising the primary containers with a permeable sterilising agent in the secondary container, placing the closed secondary container in a tertiary container, closing the tertiary container, transporting the tertiary container from said sterile sterilisation environment to a transfer port to said line, removing the secondary container from the tertiary container at said transfer door.

The present invention also describes a device for the automatic handling of primary containers for pharmaceutical use arranged in a secondary container equipped with a bottom, side walls, an access mouth, and positioning seats arranged in rows configured to house said primary containers without mutual contact, characterised in that it comprises a retaining tool engageable to close said access mouth and configured to retain all the primary containers in the respective positioning seats, a tool for dragging the secondary container and configured for the gradual opening of said access mouth and the release in succession one at a time of said rows of primary containers, and a device for picking and transferring the rows of primary containers released by said retaining tool.

Such a picking and transfer device for example comprises a conveyor spiral.

Other features of the present invention are further described in the following claims.

BRIEF DESCRIPTION OF THE DRAWINGS

Further features and advantages of the invention will become more apparent from the description of a preferred but non-exclusive embodiment of method for handling primary containers for pharmaceutical use transported along an automatic treatment line operating in a controlled environment from a contamination point of view according to the invention, illustrated by way of non-limiting example in the accompanying drawings, in which.

DETAILED DESCRIPTION

Figure 1:
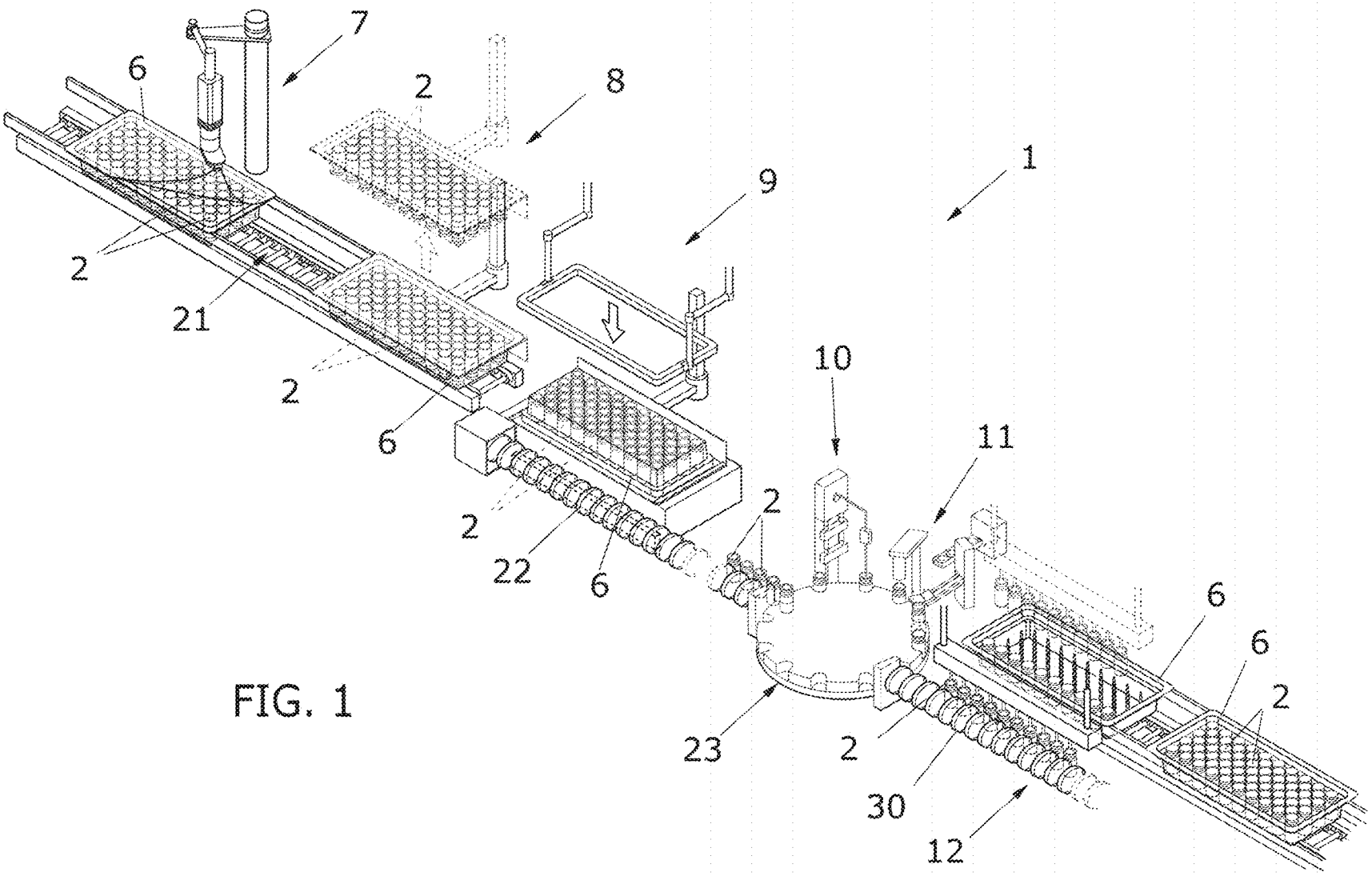
FIG. 1 schematically shows the treatment line.
Figure 2:
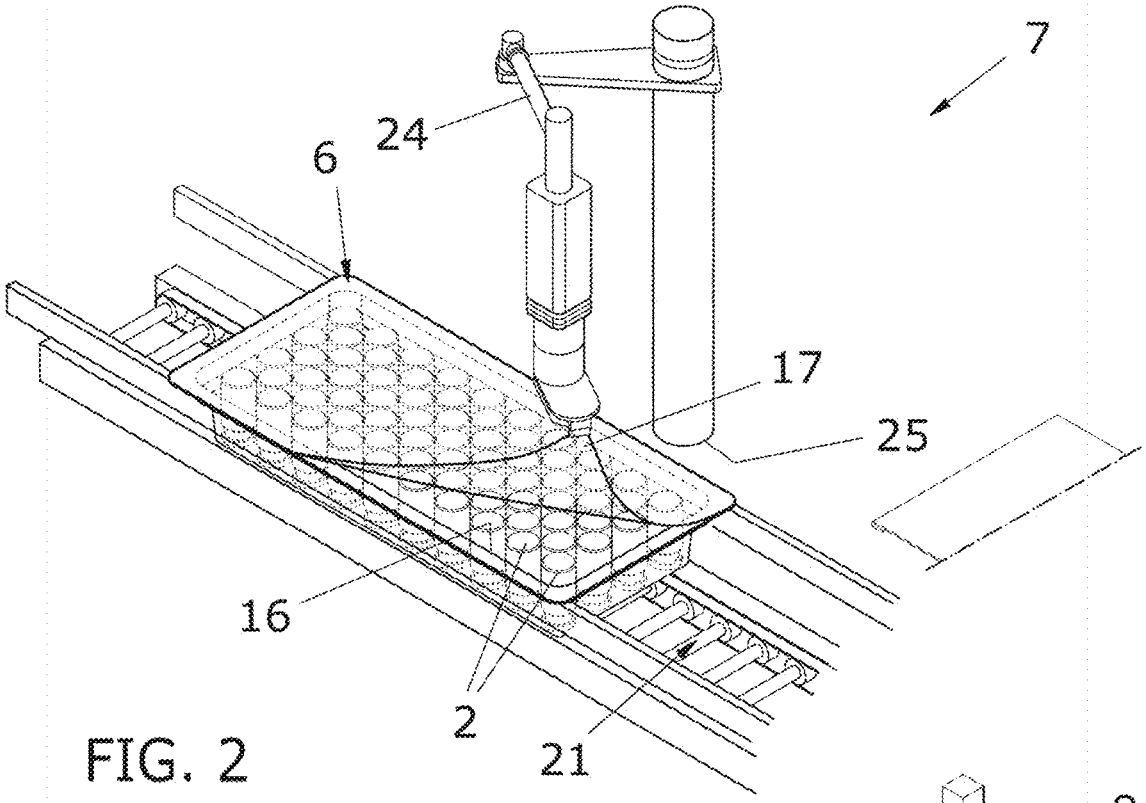
FIG. 2 shows the opening station of the secondary container.
Figure 3:
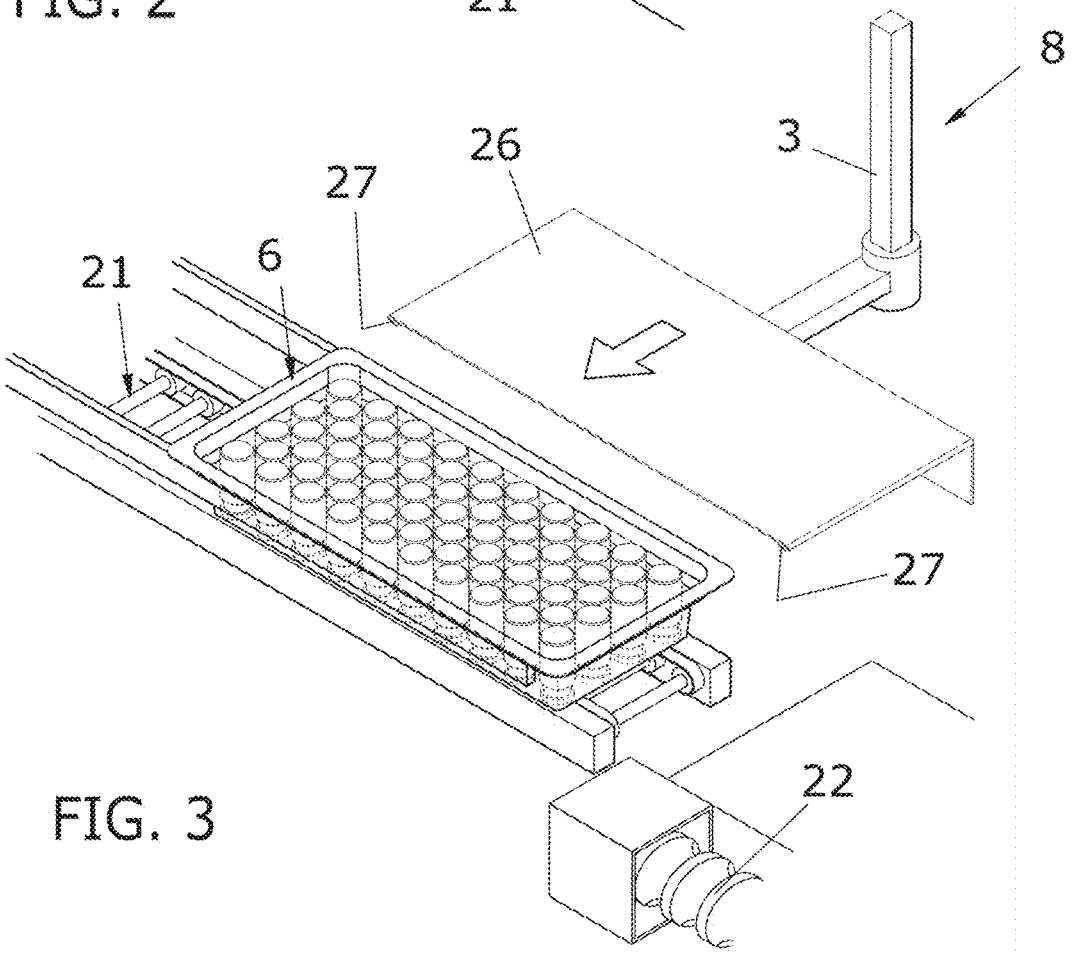
FIGS. 3, 4, 5, 6 and 7 show the secondary container overturning station in sequential steps of the overturning operation.
Figure 4:
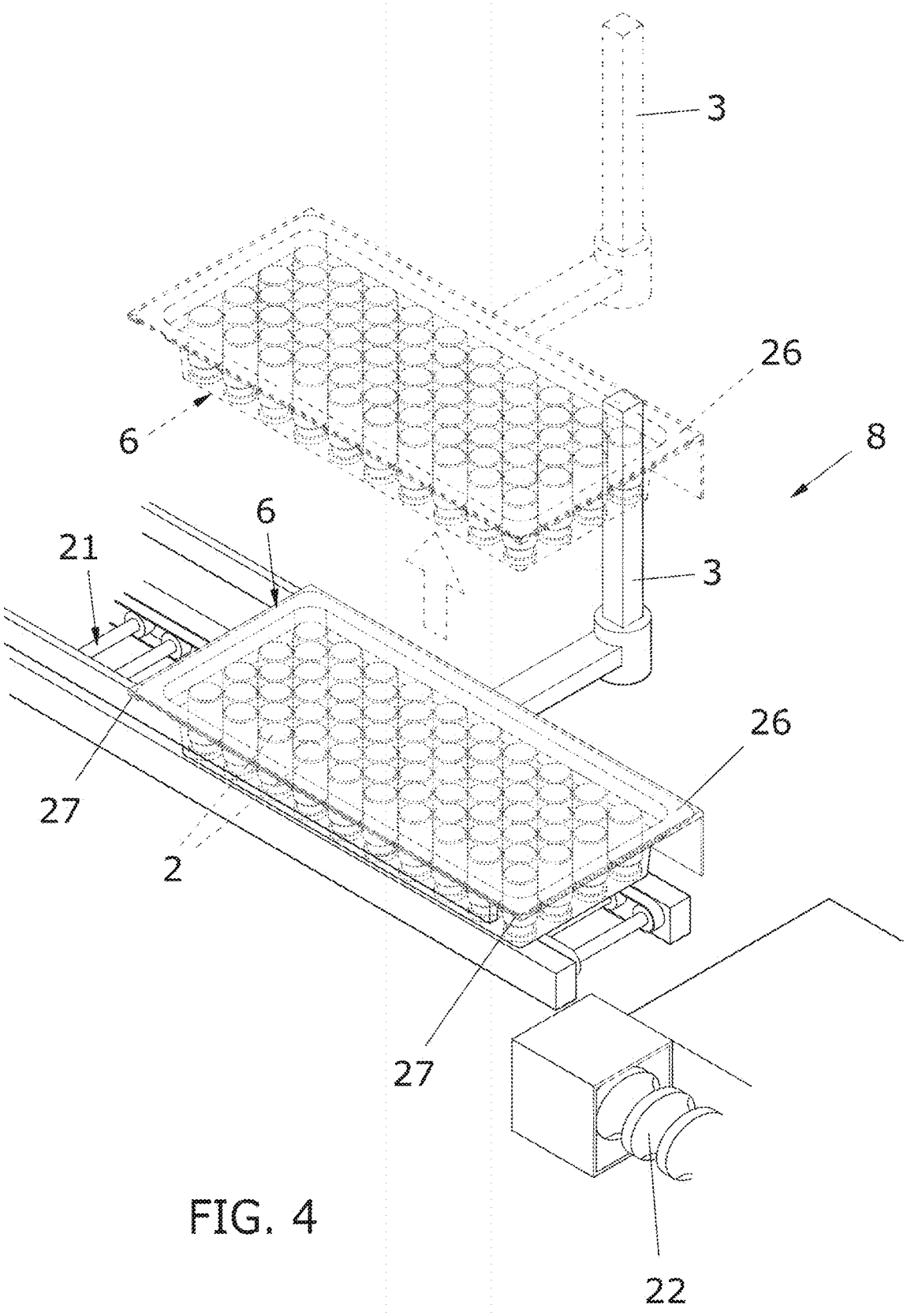
Figure 5:
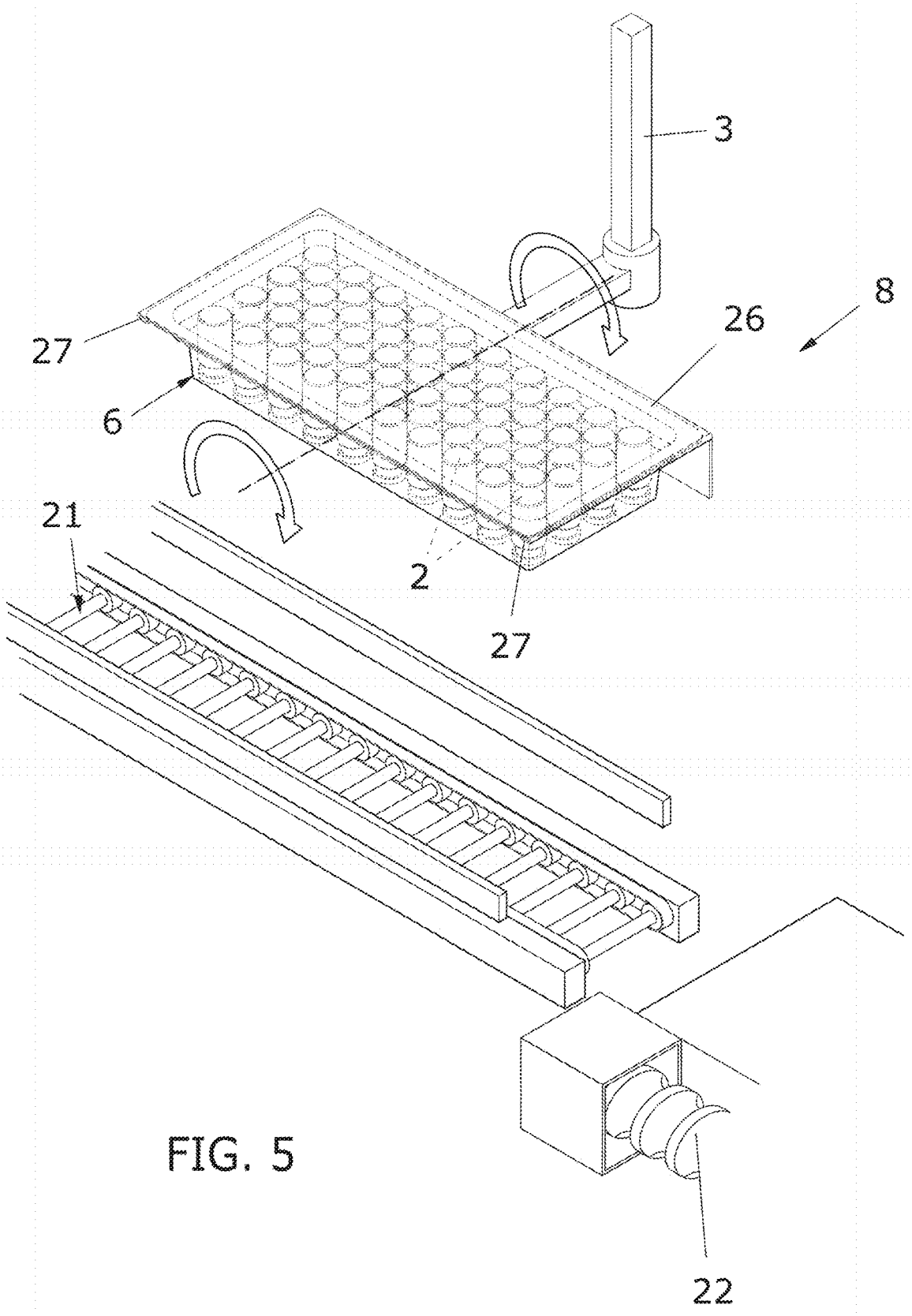
Figure 6:
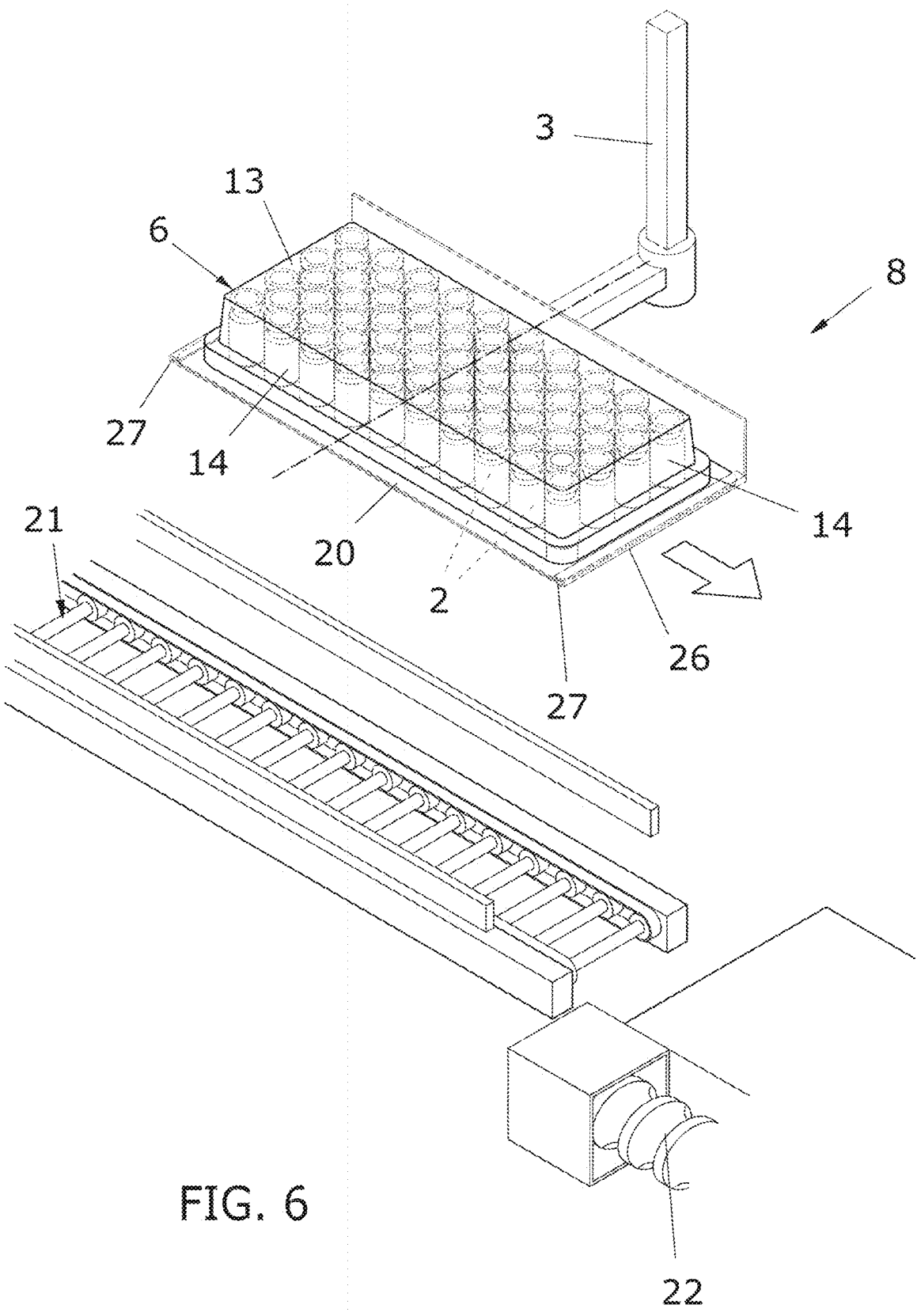
Figure 7:
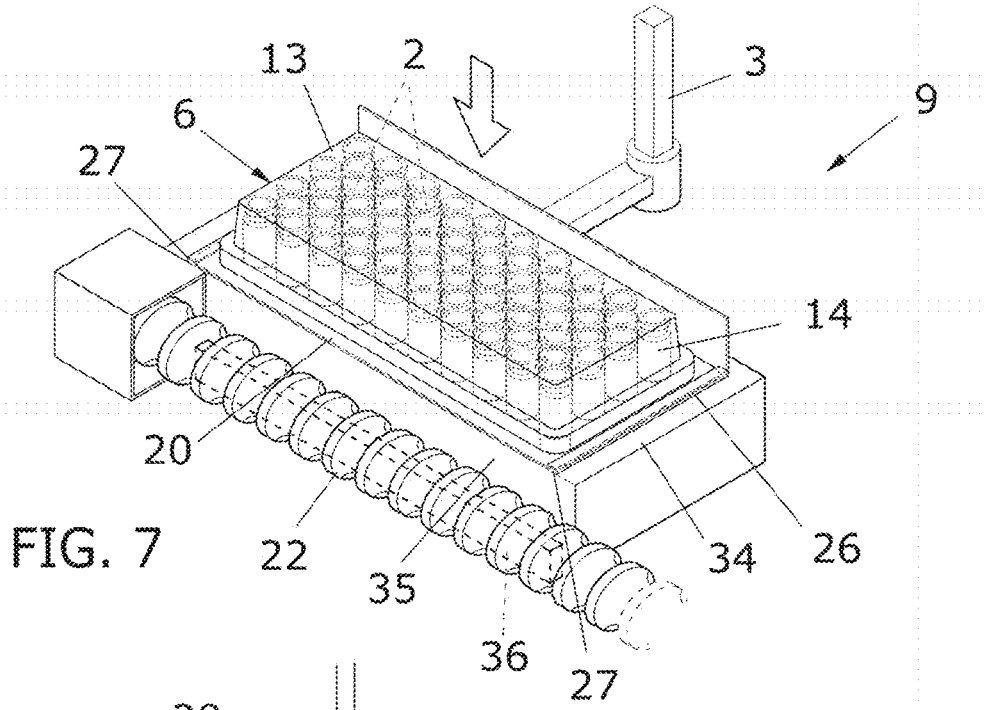
Figure 8:
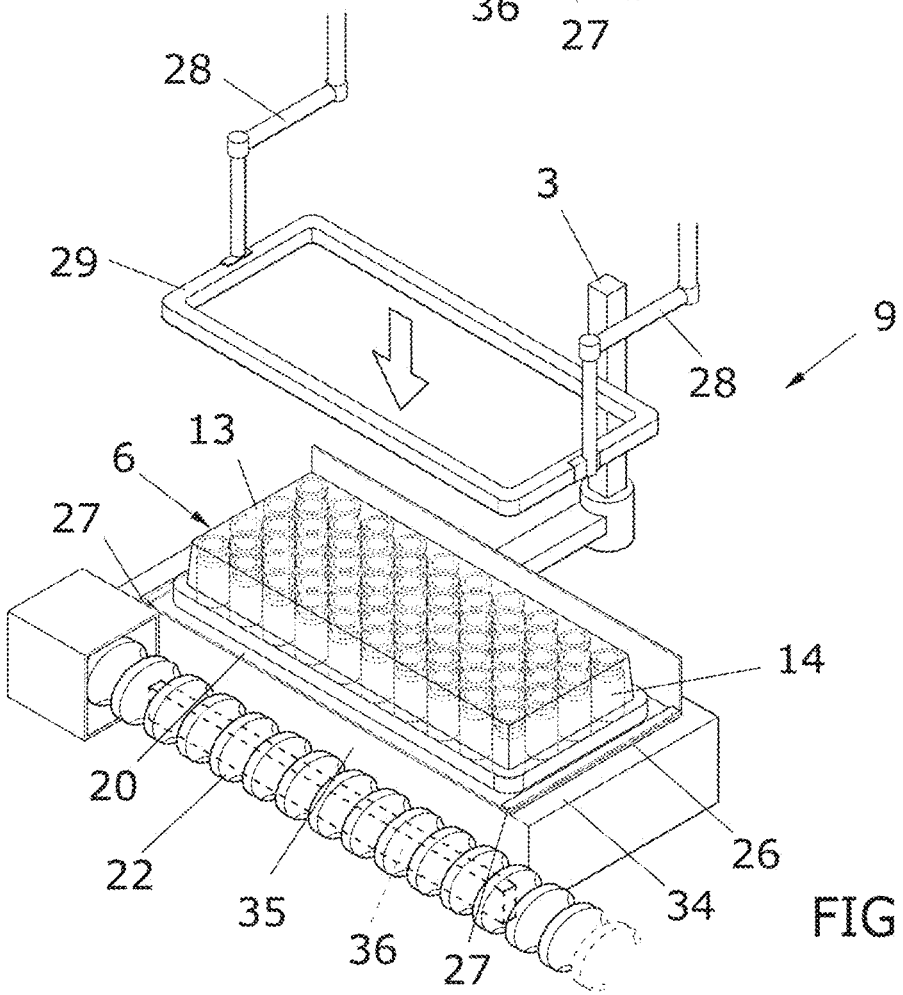
FIGS. 8, 9, 10, 11 and 12 show the extraction station of the primary containers from the secondary container, shows a detail of the automatic line at the opening stations of the secondary container, in sequential steps of the overturning operation.
Figure 9:
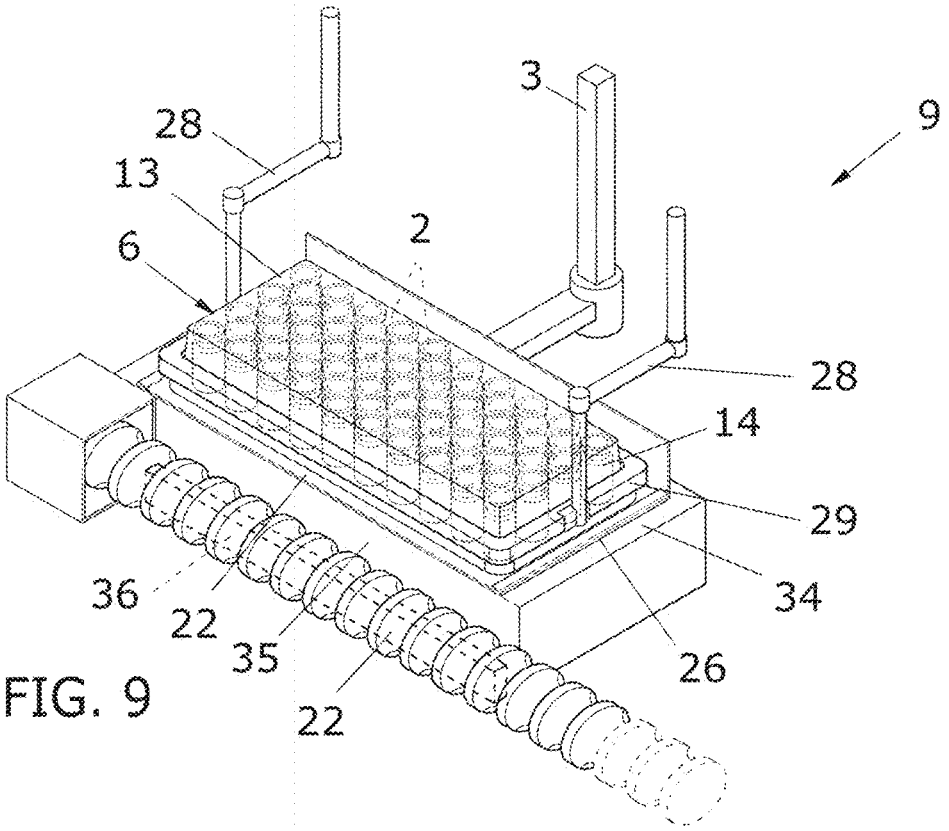
Figure 10:
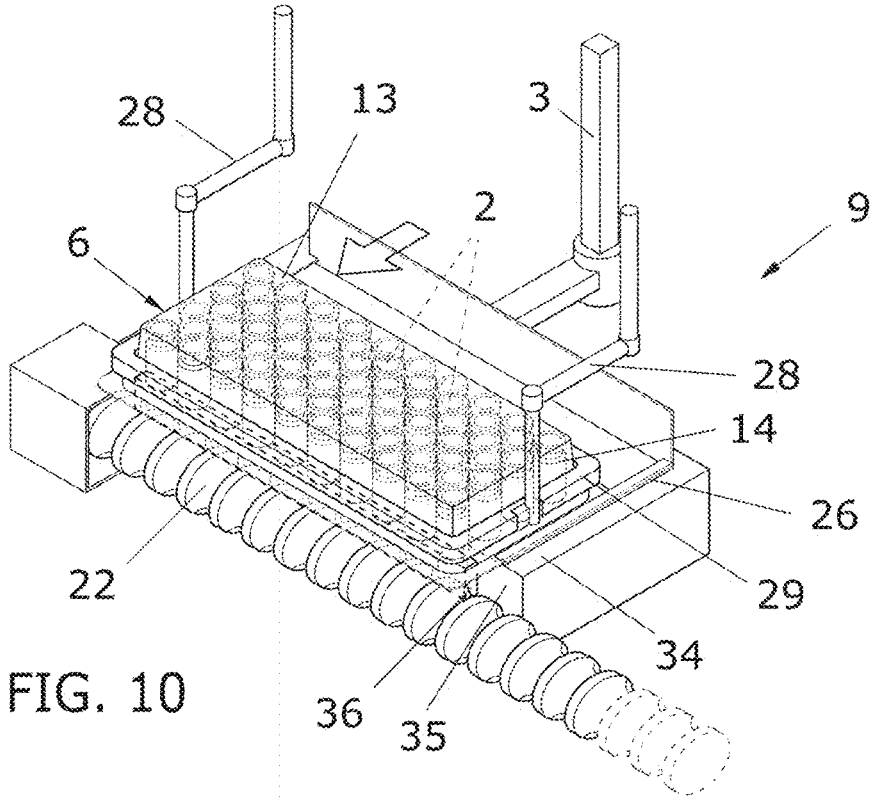
Figure 11:
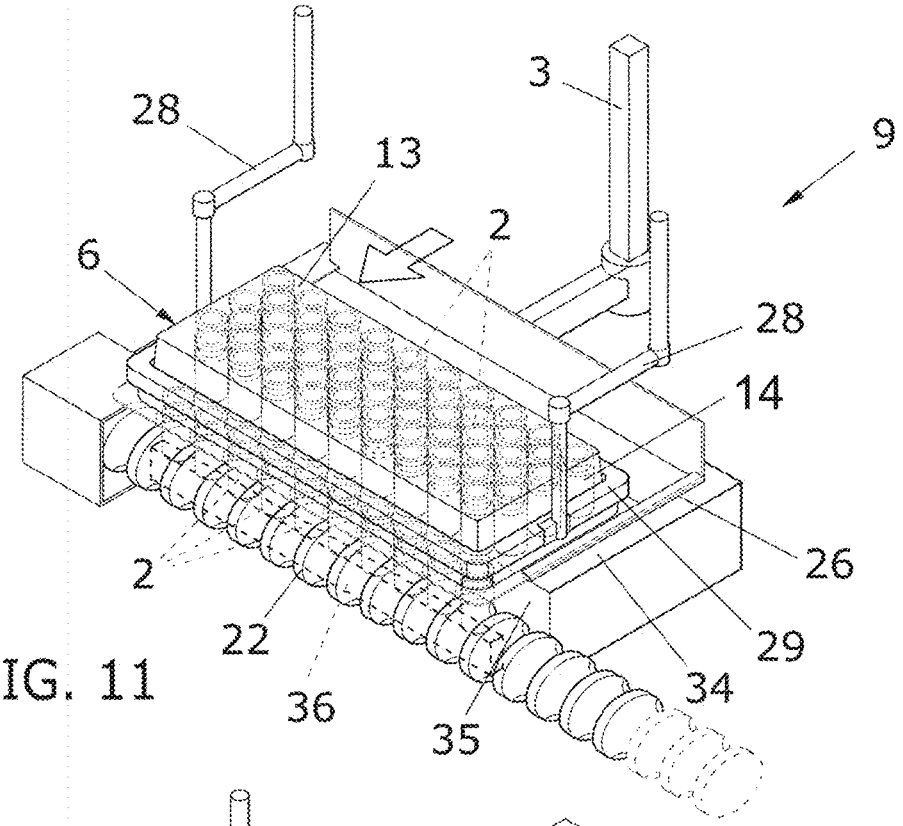
Figure 12:
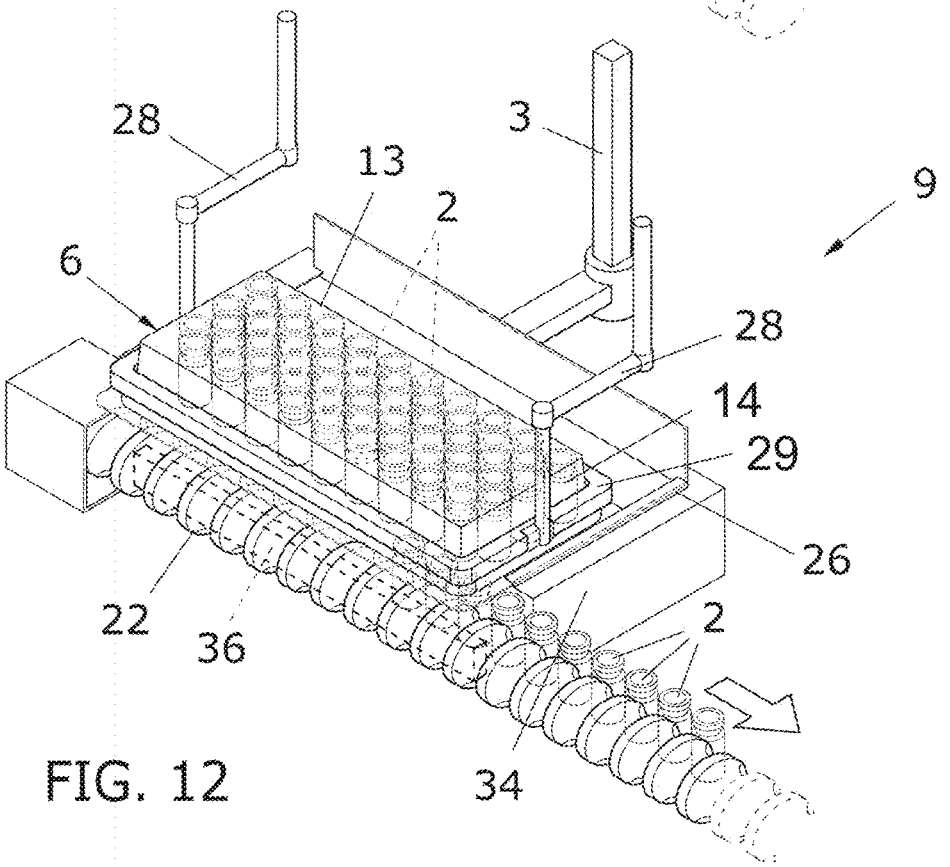
Figure 13:
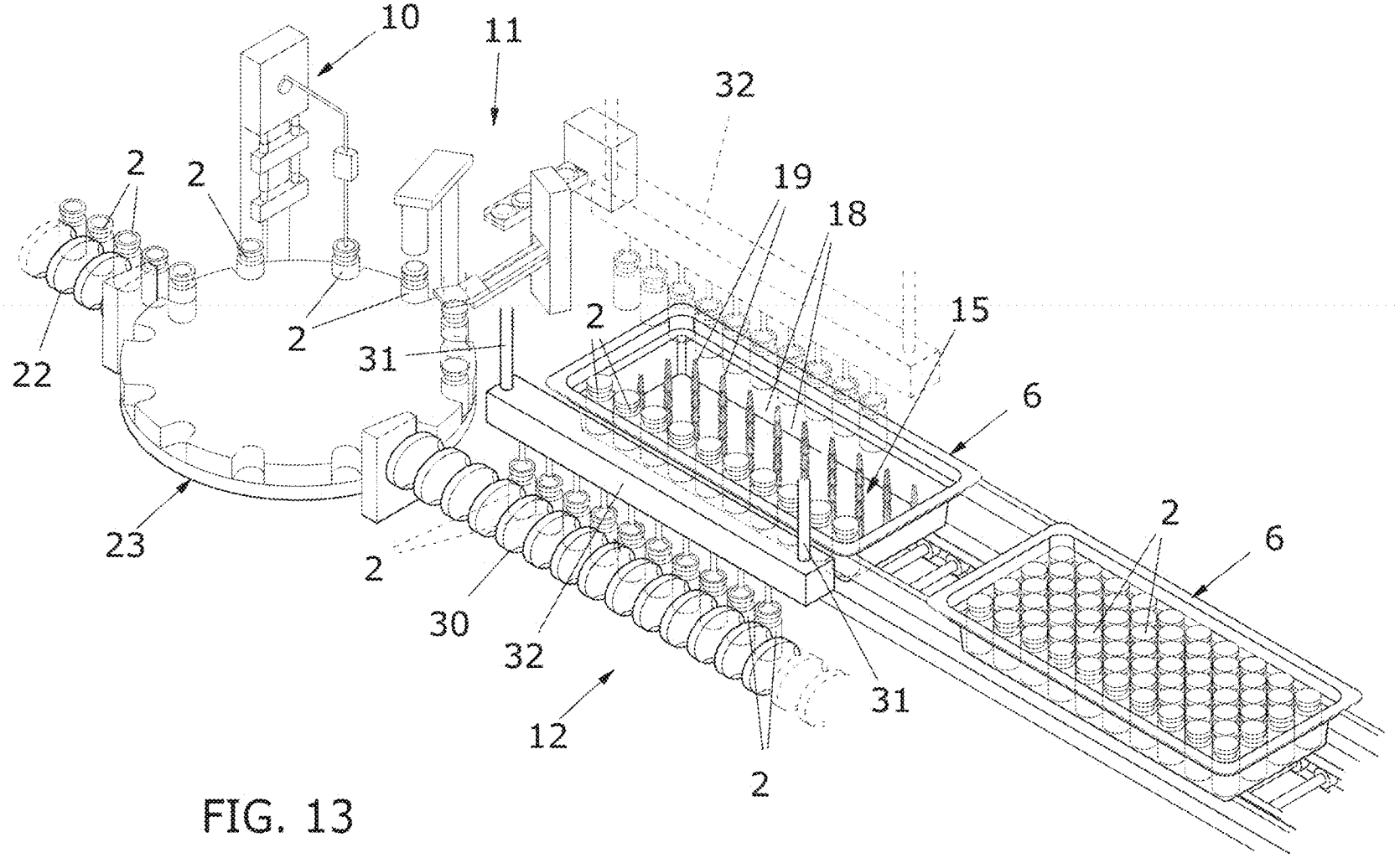
FIG. 13 shows the stations for filling, capping and repositioning the filled and capped primary containers in the secondary container.

With reference to the above figures, a preferred embodiment of the invention is shown, which comprises an automatic treatment line operating in a controlled environment from the contamination point of view, such as a sterile environment, indicated as a whole with reference numeral 1, along which primary containers 2, such as in glass or plastic, for drugs, such as liquid or powdered, are transported to be handled.

The automatic treatment line generally comprises a sterile chamber (not shown) having at least one access door and at least one exit port, a succession of workstations 7, 8, 9, 10, 11, 12, and motorised transport means of the primary containers 2 through the workstations. Advantageously, the primary containers 2 transported along the treatment line 1 perform a part of their travel grouped in a secondary container 6, where they are accommodated without mutual contact to be handled all at the same time, and part of their travel outside the secondary container 6, again without mutual contact to be handled individually in succession. In the specific case shown, workstations 7, 8, 9, 10, 11, 12 comprise, in succession along the feeding direction of the primary containers 2, an opening station 7 of the secondary container 6, an overturning station 8 of the secondary container 6, a station 9 for the grouped extraction of the primary containers 2 from the secondary container 6, a filling station 10, a capping station 11, a station 12 for reintroducing the filled and capped primary containers 2 in the secondary container 6.

Of course, the number and type of workstations may also be different from that shown.

For example, the overturning station 8 is provided, as will be seen, for the sole reason that the primary containers 2 are housed in the secondary container 6 in overturned position, that is to say, with the filling mouth thereof facing downwards, and it would not be required in a different embodiment of the invention in which the primary containers 2 are housed in the secondary container 6 not in overturned position, that is to say, with the filling mouth thereof facing upwards, in the correct orientation for filling.

In the case described, reference will be made to primary containers 2 comprising bottles but the same concept applies to other types of primary containers 2, such as glass containers for pharmaceutical use such as vials, ampoules, cartridges, syringes, etc.

The secondary container 6, quadrangular in shape, comprises a bottom 13, side walls 14 defining a containment compartment 15 and an access mouth 16 of the secondary container 6, and a removable lid 17 applicable to close the access mouth 16.

Seats 18 are formed in the containment compartment 15 for placing the primary containers 2 configured to accommodate without mutual contact the primary containers 2.

The positioning seats 18 are delimited by separation pins 19 that extend from bottom 13 of the secondary container 6.

The separation pins 19 define a plurality of positioning seats 18 arranged in a series of parallel rows.

Lid 17 preferably comprises a membrane selectively permeable to a sterilising agent that ensures the sterility over time.

Bottom 13 of the secondary container 6 is closed but in a different embodiment, it may have through openings, particularly at each positioning seat, and in turn be covered externally by a membrane selectively permeable to the sterilising agent. This solution can be used in case one wants to perform the sterilisation of the primary containers 2 also through the bottom of the secondary container. Moreover, after removing the membrane, the openings in the bottom of the secondary container can be used for the passage of suitable extraction actuators of the primary containers from the secondary container itself.

Bottom 13, the side walls 14 and the positioning seats 18 of the secondary container 6 are preferably made as a single piece of plastic.

The secondary container 6 further has an outer flange 20 which develops peripherally to the access mouth 16.

Flange 20, in addition to providing a sufficiently large fastening area where the outer edge of lid 17 is welded or glued, also serves for picking the secondary container 6.

The transportation means defines a horizontal feeding path and in the specific example described, they comprise in succession a horizontal motorised roller conveyor 21, a horizontal conveyor spiral 22, a carousel rotating in a horizontal plane, and a further horizontal conveyor spiral 30.

Station 7 for opening the secondary container fed by the roller conveyor 21 comprises a robotic arm 24 supporting a picking tool 25, such as a clamp suitable for gripping an edge of the lip and detaching it from flange 20.

Station 8 for overturning the secondary container 6, also fed by the roller conveyor 21, comprises a robotic arm 3 supporting a retainer tool 26 engageable with the access mouth 16 of the secondary container 6 and configured for retaining simultaneously all the primary containers 2 in the respective positioning seats 18. The retainer tool 26 comprises a flat quadrangular sheet which can be overlapped to the access mouth 16 of the secondary container 6 and having a perimeter configured to match the perimeter of flange 20.

In the case shown, the retainer tool 26 slidably couplable to the access mouth 16 of the secondary container 6 in a direction orthogonal to the rows of positioning seats 18.

In a variant of the invention, an axial coupling with vertical movement may be provided.

By way of example, along two parallel sides of the peripheral edge of the quadrangular sheet, L-shaped flaps 27 are formed which act as a support and sliding guide for two corresponding parallel sides of flange 20.

Station 9 for extracting the primary containers 2 in groups from the secondary container 6, arranged at the conveyor spiral 22, comprises a robotic arm 28 supporting a dragging tool 29 of the secondary container 6.

Tool 29 for dragging the secondary container 6 is in particular formed by a belt that surrounds the side walls of the secondary container 6.

The filling station 10 and the capping station 11, of a known type, are positioned at different points along the perimeter of carousel 23 or, in a variation of the invention not shown, along the linear transportation axis of the vials.

Station 12 for reintroducing the filled and capped primary containers 2 in the secondary container 6, located at the conveyor spiral 30, comprises a robotic arm 31 supporting a tool 32 for extracting the primary containers 2 in groups from the conveyor spiral 30 and placing them in the secondary container 6, which tool 32 for example comprises a series of suction cups or clamps.

The treatment line 1 works as follows. Firstly, in a sterile sterilisation environment, the primary containers 2 are deposited in the positioning seats 18, then the closing lid 17 is applied to the secondary container 6, then the sterilisation of the primary containers 2 is carried out with a sterilising treatment through the secondary container 6, for example by flushing with a sterilising gaseous agent or by exposure to gamma rays), then the secondary container 6 is placed in a tertiary container which is closed and transferred to the access door of the sterile filling chamber where the tertiary container is finally removed.

Advantageously, during the entire transport within the sterile filling chamber, the primary containers 2 move separately from each other without any mutual contact.

The handling method involves the extraction of the primary containers 2 in succession.

Alternatively, it may be provided to extract complete rows or parts of rows or a single primary container 2 in succession one at a time from the secondary container 6, while maintaining the primary containers 2 separate, and transfer in succession one at a time the separate primary containers 2 to the filling station 10 and then to the capping station 11.

Preferably, the handling method contemplates that after capping, the primary containers 2, in groups corresponding to the number of positioning seats that make up a row, are transferred again in the secondary container 6 without coming into contact with each other.

More in detail, the filling line works as follows.

The secondary container 6 in input into the sterile chamber advances at the opening station 7 where it stops and is opened, then restarted up in correspondence of the overturning station 8 where it is overturned to bring the primary containers 2 in the correct position for filling. To perform the overturning, the robotic arm 3 makes the retainer tool 26, in succession, carry out a first translation movement as a result of which the retainer tool 26 is coupled with the access mouth 16 of the secondary container 6 up to the complete closure of the latter, a second translation movement as a result of which the retainer tool 26 raises the secondary container 6 from the roller conveyor 21, a third 180° rotational movement as a result of which the retaining tool 26 overturns the secondary container 6, and a fourth linear movement as a result of which the retaining tool 26 lays the overturned secondary container 6 on a fixed horizontal resting surface 34 surmounting the conveyor spiral 22.

It should be understood that in a variant of the invention, the conveyor spiral 22 is replaced by another type of indexed or known or incremental step feeding system.

The secondary container 6 is in particular deposited on the support surface 34 with the rows of positioning seats 18 oriented parallel to a side 35 of the support surface intended for the exit of the primary containers 2. The output side 35 of the support surface 34 is in turn oriented parallel to the axis of the conveyor spiral 22. Once the secondary container 6 is deposited on the support surface 34, the robotic arm 28 makes tool 29 carry out first linear descent motion as a result of which tool 29 engages the secondary container 6, and a second horizontal linear movement as a result of which the secondary container 6 is progressively moved towards the output side 35 of the primary containers 2 up to go beyond it. As it advances beyond the output side 35 of the support surface 34, the secondary container 6 is progressively released from the retainer tool 26 and progressively opens the access door 16. When the opening gap of the access mouth 16 is sufficiently wide to expose the first row of positioning seats 18, the first row of primary containers 2 drops due to the force of gravity. The first dropped row of primary containers 2 is intercepted by a support bar 36 which stops each primary container 2 in a corresponding space between two adjacent turns of the conveyor spiral 22. At this point, by rotating, the spiral conveyor 22 advances the first row of primary containers 2 until the latter are picked one at a time from carousel 23. The rotation of the conveyor spiral 22 is synchronised with the movement of the secondary container 6 so that, as soon as the support bar 36 is freed of the last primary container 2 of the first row, the opening gap of the access mouth 16 is enlarged so as to also expose the second row of positioning seats 18 to allow the drop of the second row of primary containers 2 on the support bar 36. The sequence continues up to the drop of the last row of primary containers 2.

The pitch of the conveyor spiral 22 determines the pitch of spacing between the primary containers that are transferred to carousel 23.

By suitably selecting the pitch of the conveyor spiral 22, it is therefore possible to change the pitch of spacing between the primary containers 2 accommodated in the secondary container 6 and the pitch of spacing between the primary containers 2 that are transferred to carousel 23 in a row. The primary containers 2 are moved up to the filling and capping without changing their orientation. After capping, carousel 23 transfers the primary containers 2 to the conveyor spiral 30 from which they are picked in groups equal to the number of positioning seats 18 of which each row is composed.

Each group of primary containers 2 picked is then repositioned in a row of positioning seats 18 of the secondary container 6, which in the meantime has been automatically moved to a predefined position of the reintroduction station 12.

Several changes and variations may be made to the method for handling primary containers for pharmaceutical use transported along an automatic treatment line operating in a controlled environment from a contamination point of view thus conceived, all falling within the inventive concept; moreover, all details can be replaced with technically equivalent elements.

For example, in a variant of the invention not shown, the filling station is preceded by a washing station of the primary containers 2. In this case, the primary containers 2 are accommodated in the secondary container 6 in non-inverted position, namely with their filling mouth facing upwards, in such a way that the overturning station 8 overturns the secondary container 6 and the primary containers 2 are brought to the correct position for washing.

Moreover, in another variant of the invention not shown, the sterile area is divided by a door into two areas of which the first area is intended to overturn and extract by gravity the primary containers 2 and the second area is instead intended for the various treatment steps of the primary container, e.g., filling, capping and others.

In practice, the materials used and the dimensions can be any according to the requirements and the state of the art.

The invention claimed is:

1. A method for handling primary containers for pharmaceutical use transported along an automatic treatment line operating in a controlled environment from a contamination point of view and comprising at least one treatment station for treating the primary containers, comprising the following steps:

introducing into said line a secondary container equipped with rows of positioning seats housing said primary containers separately from one another;

extracting the primary containers in succession keeping the primary containers separate from one another, wherein a whole row of primary containers at a time or part of a row of primary containers at a time or one primary container at a time are extracted in succession;

transferring the extracted primary containers to said treatment station in succession one at a time, and performing said treatment step, the method further comprising overturning the secondary container comprised between the introduction and the extraction step of the primary containers.

2. The handling method according to claim 1, wherein in the transfer to said treatment station the primary containers are kept separate from one another.

3. The handling method according to claim 1, wherein an orientation with which the primary containers are arranged in the positioning seats is chosen according to the orientation assumed by the primary containers during the performance of the treatment step.

4. The handling method according to claim 1, wherein after the treatment step said primary containers are relocated in said secondary container without coming into contact with one another prior to the extraction from said line.

5. The handling method according to claim 1, wherein a distancing pitch between the primary containers transferred to the treatment station is varied with respect to the distancing pitch between the primary containers housed in said positioning seats.

6. The handling method according to claim 1, wherein said secondary container comprises a bottom, side walls that delimit an access mouth to the secondary container, and a removable lid applied to close said access mouth and comprising a membrane made of material that is selectively permeable to a sterilizing agent.

7. The handling method according to claim 6, wherein said bottom has through holes lined with a further membrane that is selectively permeable to the sterilizing agent.

8. A method for handling primary containers for pharmaceutical use transported along an automatic treatment line operating in a controlled environment from a contamination point of view and comprising at least one treatment station for treating the primary containers, comprising the following steps:

introducing into said line a secondary container equipped with rows of positioning seats housing said primary containers separately from one another;

extracting the primary containers in succession keeping the primary containers separate from one another, wherein a whole row of primary containers at a time or part of a row of primary containers at a time or one primary container at a time are extracted in succession;

transferring the extracted primary containers to said treatment station in succession one at a time, and performing said treatment step, wherein the primary containers of each of said whole rows extracted in succession one at a time are placed down simultaneously each in a corresponding space between two adjacent turns of a conveyor spiral to the treatment station.

9. The handling method according to claim 8, wherein said whole rows extracted in succession one at a time are guided in gravitational fall towards said spiral.

10. A method for handling primary containers for pharmaceutical use transported along an automatic treatment line operating in a controlled environment from a contamination point of view and comprising at least one treatment station for treating the primary containers, comprising the following steps:

introducing into said line a secondary container equipped with rows of positioning seats housing said primary containers separately from one another;

extracting the primary containers in succession keeping the primary containers separate from one another, wherein a whole row of primary containers at a time or part of a row of primary containers at a time or one primary container at a time are extracted in succession;

transferring the extracted primary containers to said treatment station in succession one at a time, and performing said treatment step, wherein the primary containers are placed in an overturned position in said positioning seats and said secondary container, once open, is engaged by a retaining tool of the primary containers, and wherein said retaining tool is activated so as to overturn the secondary container and arrange the primary containers with a correct orientation for the treatment.

11. The handling method according to claim 10, wherein, once the secondary container has been overturned, the retaining tool is moved with respect to the secondary container so as to free the primary containers.

12. The handling method according to claim 10, wherein once the secondary container has been overturned, the primary containers are moved as far as the treatment station without their orientation being changed.

13. A device for the automatic handling of primary containers for pharmaceutical use arranged in a secondary container equipped with a bottom, side walls, an access mouth, and positioning seats arranged in rows configured to house said primary containers without mutual contact, the device comprising:

a retaining tool engageable to close said access mouth and configured to retain all the primary containers in the respective positioning seats, a tool for dragging the secondary container and configured for the gradual opening of said access mouth and the release in succession one at a time of said rows of primary containers, and a device for picking and transferring the rows of primary containers released by said retaining tool.

14. A device for the automatic handling of primary containers for pharmaceutical use according to claim 13, wherein the primary containers are placed in an overturned position in said positioning seats and said secondary container, once open, is engaged by the retaining tool of the primary containers, wherein said retaining tool is activated so as to overturn the secondary container and arrange the primary containers with a correct orientation for the treatment.

* * * * *